US007193507B2

(12) United States Patent
Yu

(10) Patent No.: US 7,193,507 B2
(45) Date of Patent: Mar. 20, 2007

(54) SIREN HOUSING

(75) Inventor: Liming Yu, New York, NY (US)

(73) Assignee: Mascon, Inc., Woburn, MA (US)

( * ) Notice: Subject to any disclaimer, the term of this patent is extended or adjusted under 35 U.S.C. 154(b) by 189 days.

(21) Appl. No.: 11/105,741

(22) Filed: Apr. 14, 2005

(65) Prior Publication Data

US 2006/0232434 A1 Oct. 19, 2006

(51) Int. Cl.
*G08B 3/00* (2006.01)

(52) U.S. Cl. ..... 340/391.1; 340/693.5; 340/693.7; 340/693.9; 340/693.11

(58) Field of Classification Search ..... 340/693.5, 340/693.6, 693.7, 693.8, 693.9, 693.11, 693.12, 340/384.1, 391.1, 628; 70/49, 57; 604/151
See application file for complete search history.

(56) References Cited

U.S. PATENT DOCUMENTS 4,032,707 A * 6/1977 Trenary ..... 174/562
4,776,188 A * 10/1988 Dalaba et al. ..... 70/49
5,805,071 A * 9/1998 Hur ..... 340/693.9
6,271,763 B1 * 8/2001 Hur ..... 340/693.12
6,443,604 B1 * 9/2002 Rudenberg ..... 362/488
6,749,587 B2 * 6/2004 Flaherty ..... 604/151

* cited by examiner

*Primary Examiner*—Van T. Trieu
(74) *Attorney, Agent, or Firm*—Gauthier & Connors, LLP

(57) ABSTRACT

A siren housing has a dish-shaped base having a back wall adapted to be secured to as support structure. The base is configured and dimensioned to contain siren components. A post projects forwardly from the back wall. The post has a cylindrical sidewall terminating at a front rim. At least one channel circumscribes a segment of the sidewall at a location spaced rearwardly from the front rim. Entry and exit slots communicate with the channel at spaced locations along the length thereof. The entry slot leads to the front rim and the exit slot leading towards the back wall. A dish-shaped cover has a front wall. A cylindrical sleeve projects rearwardly from the front wall, the sleeve having at least one pin projecting radially inwardly therefrom. The sleeve is dimensioned for axial insertion onto the post. The pin is arranged: to enter the channel via the entry slot; and to coact with the channel in supporting the cover above the base for movement between open and closed positions; and to exit the channel via the exit slot to accommodate seating of the closed cover on the base.

8 Claims, 4 Drawing Sheets

SIREN HOUSING

BACKGROUND

1. Field of the Invention

This invention relates generally to housings for sirens.

2. Description of the Prior Art

Sirens for alarm systems typically are enclosed in housings to protect the siren components and to simplify mounting of a siren to a support structure. Siren housings usually have a base with features for holding the siren components and a cover to conceal the siren components. Installation of a housed siren usually involves mounting the siren housing base to a wall, connecting the siren components to an alarm system, and then attaching the siren housing cover to the base. Sirens are often installed high above the floor of a room to make them less noticeable when not sounding an alarm.

One problem with such siren housings is that an installer is not able to access the siren components or mount the siren housing to a wall or other support structure while the siren housing cover is attached to the siren housing base. Further, an installer usually is not able to hold the siren housing base, tools for mounting the siren housing base, and the siren cover at the same time. Compounding this problem, installation is often performed at the top of a ladder where there is no place within reach to put the siren housing cover. An installer must make a first trip up the ladder to mount the siren housing base to the support structure and a second trip to attach the siren housing cover to the base.

SUMMARY OF THE INVENTION

An objective of the present invention includes provision a siren housing that permits access to siren components and allows mounting of the siren housing to a support structure while the siren housing cover is attached to the siren housing base. An additional objective of the present invention includes provision of a method for mounting a siren housing to a support structure while a siren housing cover is attached to a siren housing base.

In one aspect of the present invention in accordance with the objective, a siren housing has a dish-shaped base having a back wall adapted to be secured to a support structure. The base is configured and dimensioned to contain siren components. A post projects forwardly from the back wall. The post has a cylindrical side wall terminating at a front rim. At least one channel circumscribes a segment of the post side wall at a location spaced rearwardly from the front rim. Entry and exit slots communicate with the channel at spaced locations along the length thereof. The entry slot leads to the front rim and the exit slot leads towards the back wall. A dish-shaped cover has a front wall. A cylindrical sleeve projects rearwardly from the front wall, the sleeve having at least one pin projecting radially inwardly therefrom. The sleeve is dimensioned for axial insertion onto the post. The pin is arranged: 1) to enter the channel via the entry slot; 2) to coact with the channel in supporting the cover above the base for movement between open and closed positions; and 3) to exit the channel via the exit slot to accommodate seating of the closed cover on the base.

In another aspect of the present invention, a method of mounting a siren housing to a wall includes providing a siren housing in accordance with the present invention. The sleeve is inserted onto the post and thereby passes the pin through the entry slot. The cover is rotated to pass the pin through the channel and align with the access slot. The sleeve is inserted further onto the post and thereby passes the pin into the access slot. The housing is mounted to a support structure. The sleeve is withdrawn from the post so that the pin passes into the channel. The cover is rotated to pass the pin through the channel and align with the exit slot. The sleeve is inserted onto the post, thereby passing the pin into the exit slot and seating the cover on the base.

These and other features and objectives of the present invention will now be described in greater detail with reference to the accompanying drawings.

DETAILED DESCRIPTION

Figure 1:
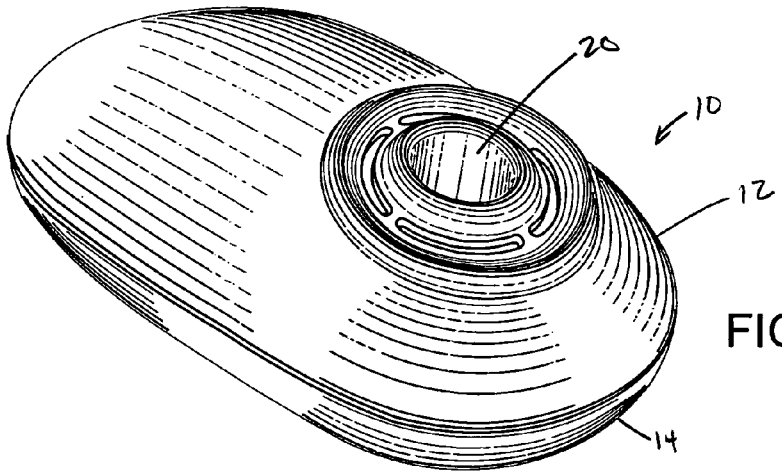
FIG. 1 is a perspective view of a siren housing in accordance with the present invention.
Figure 2:
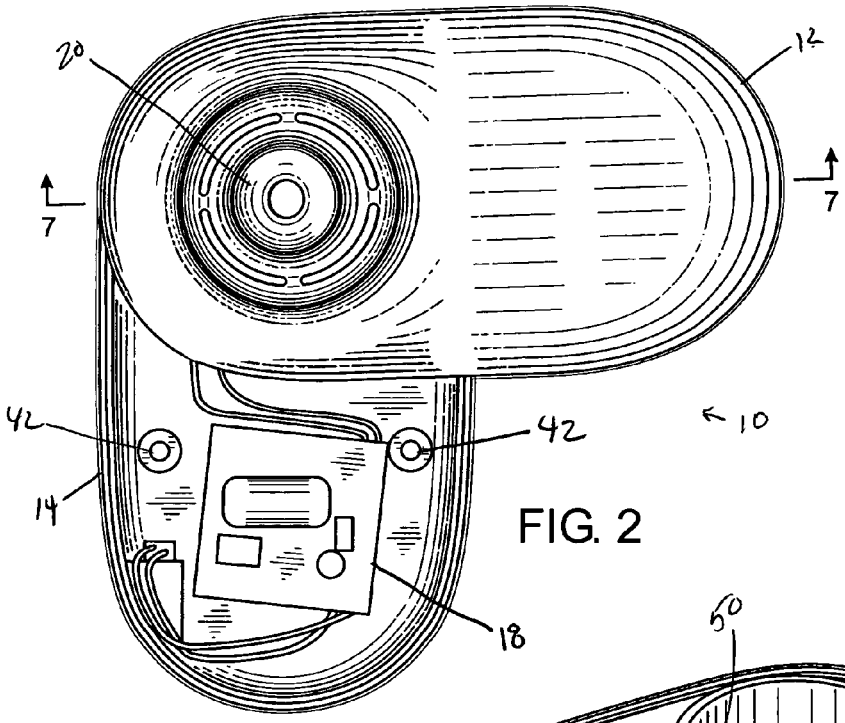
FIG. 2 is a front view of the siren housing with the cover aligned in a first position transverse to the base.
Figure 3:
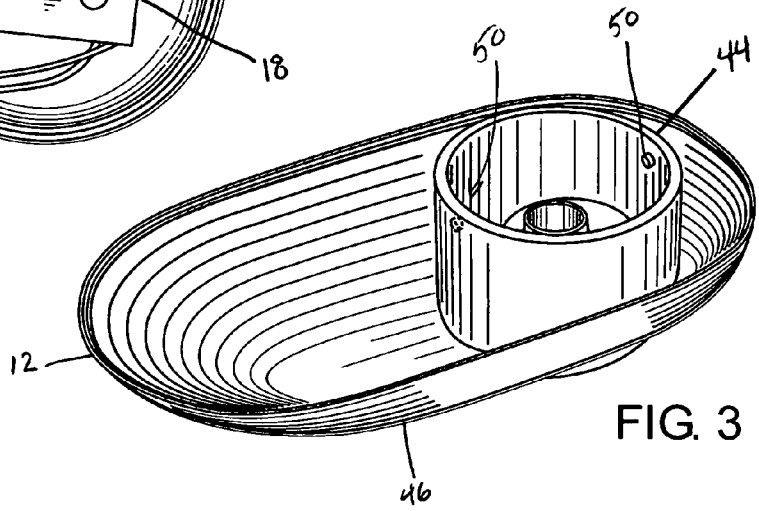
FIG. 3 is a perspective view of the interior of a siren housing cover.
Figure 4:
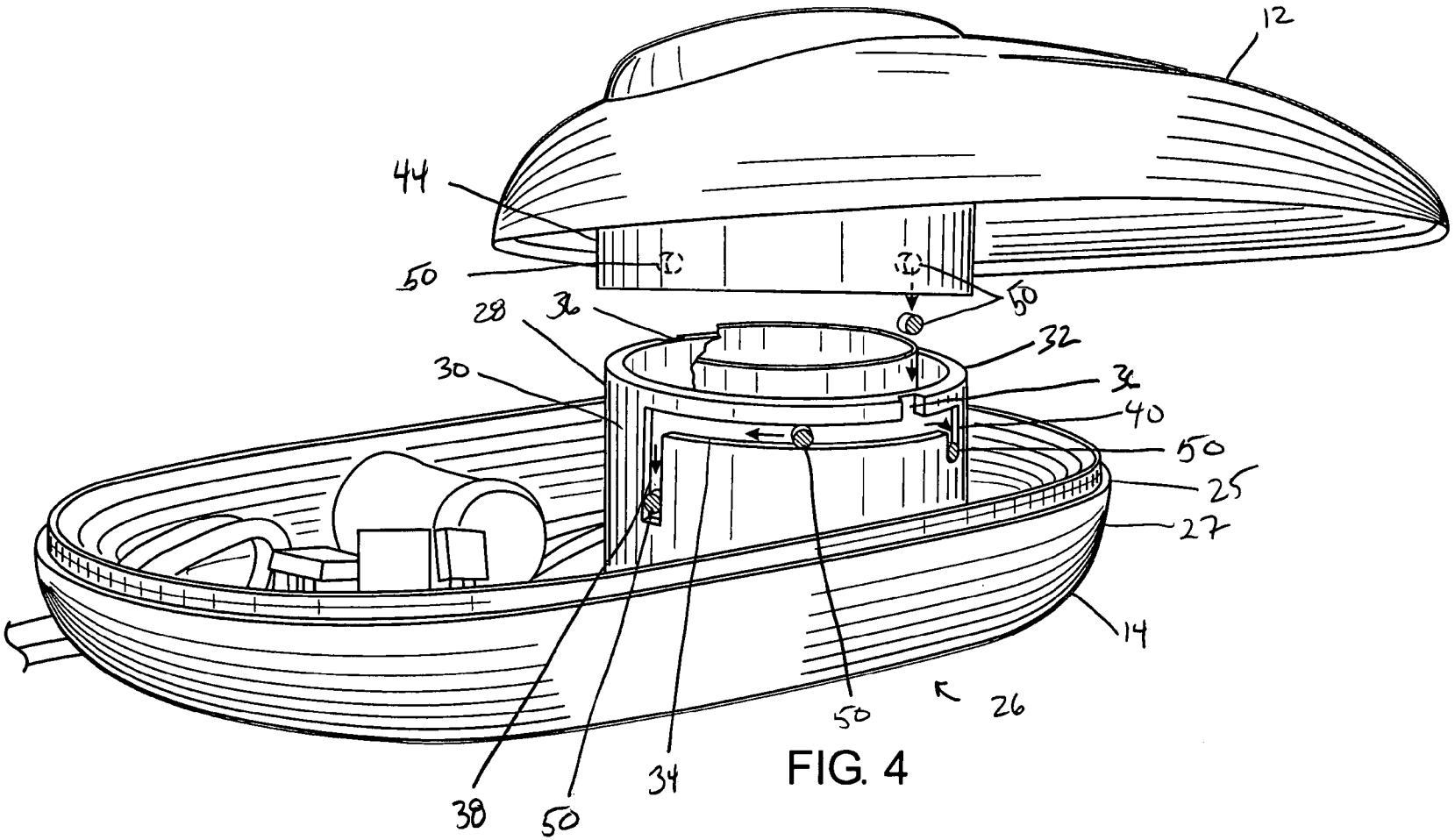
FIG. 4 is an exploded view of a siren housing showing the path traveled by a pin.
Figure 5:
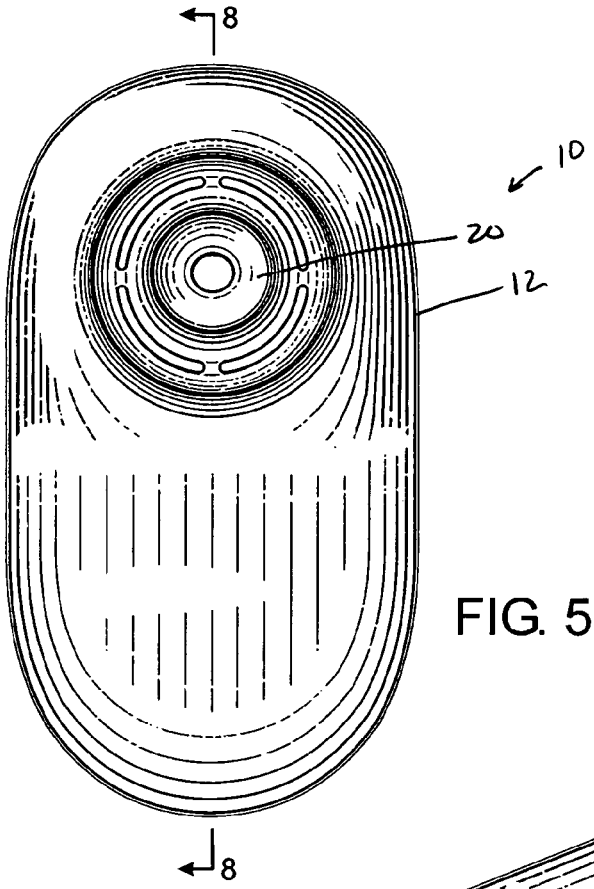
FIG. 5 is a front view of a siren housing with the cover aligned with the base.
Figure 6:
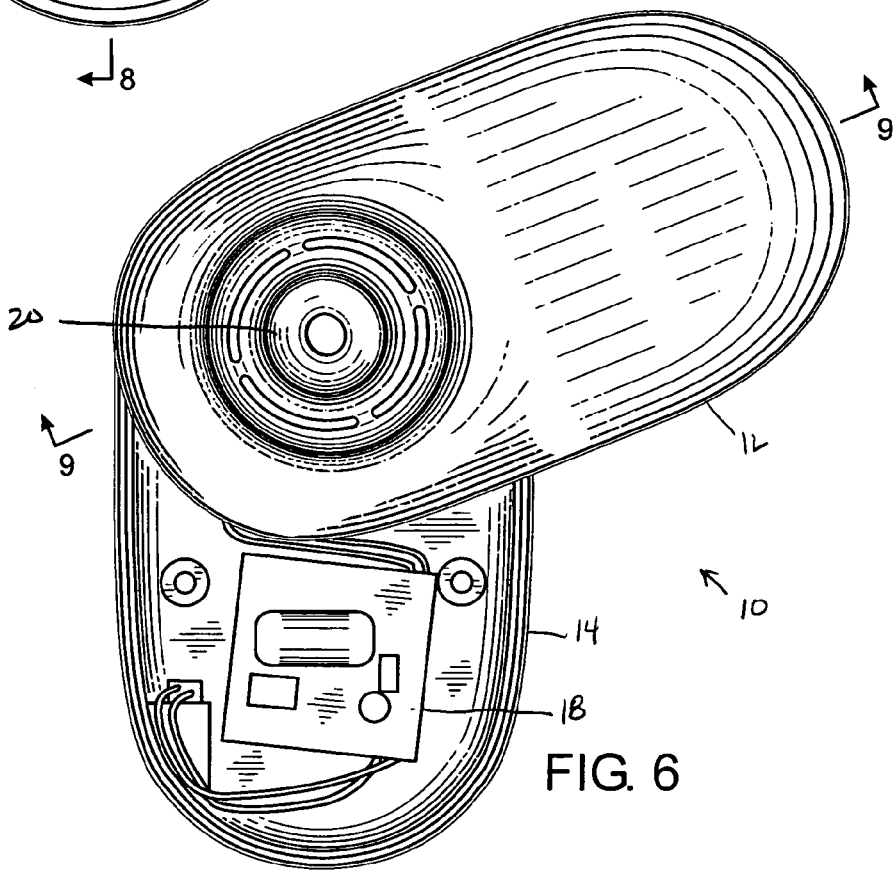
FIG. 6 is a front view of a siren housing with the cover aligned in a second position transverse to the base.
Figure 7:
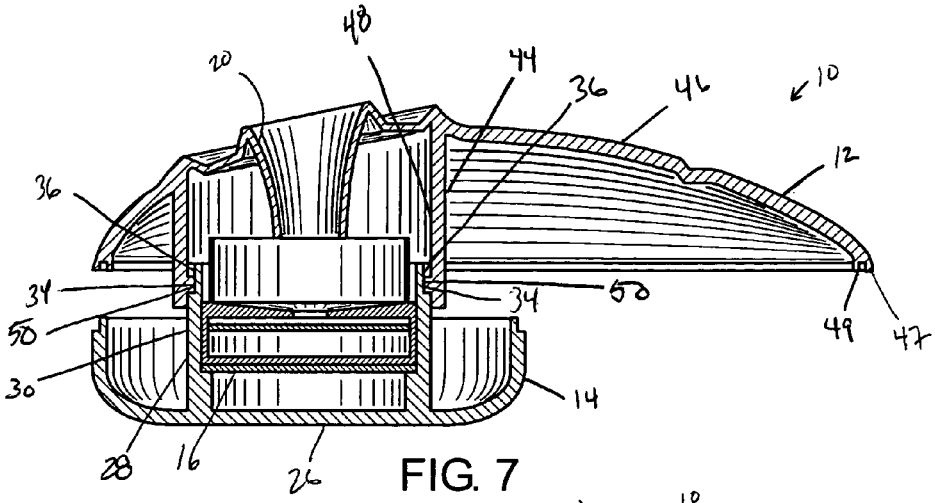
FIG. 7 is a cross sectional view of the siren housing of FIG. 2.
Figure 8:
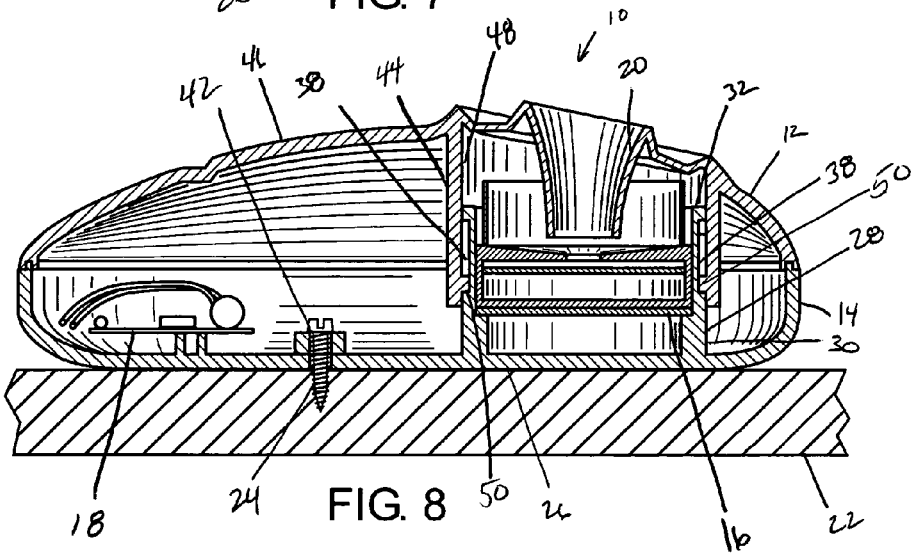
FIG. 8 is a cross sectional view of the siren housing of FIG. 5, shown mounted to a support structure.
Figure 9:
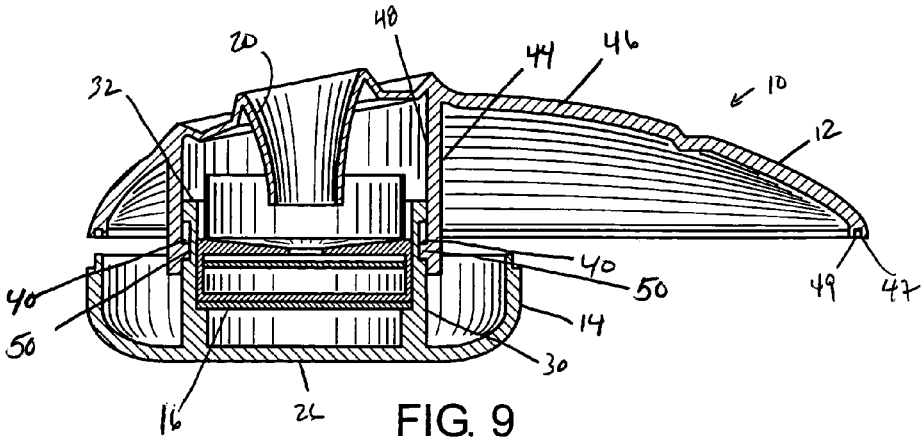
FIG. 9 is a cross sectional view of the siren housing of FIG. 6.

Referring to FIGS. 1, 4, and 8, a siren housing 10 is shown having a dish-shaped cover 12 and a dish-shaped base 14. A siren 16 and a circuit board 18 having circuitry for operating the siren 16 are attached to the base 14. A funnel-shaped speaker is formed in the front wall 22 of cover 12 for amplifying the output of siren 16. Housing 10 is mounted to a support structure 22 by a pair of screws 24 (only one shown) through back wall 26.

Referring to FIGS. 4 and 7–9 base 14 has a back wall 26 and a side wall 27 extending to a step 25 where side wall 27 is reduced in thickness. A hollow post 28 projects forwardly from back wall 26 of base 14 with siren 26 seated within the interior thereof. Post 28 has a cylindrical side wall 30 terminating at a front rim 32. Formed in side wall 30 is a pair of diametrically opposed channels 34 circumscribing the perimeter of post 28. Only one channel 34 is shown in FIG. 4 and both channels 34 are shown in cross section in FIG. 7. Channels are substantially parallel with back wall 26. Entry slots 36 are also formed in side wall 30. Each entry slot 36 communicates between front rim 32 and a middle portion of channel 34. Exit slots 38 are formed in side wall 30, communicate with an end of each channel 34, and extend rearwardly toward back wall 26. As described in more detail below, exit slots 38 are configured to accommodate the seating of cover 12 on base 14 to close siren housing 10. Access slots 40 are formed in side wall 30, communicate with opposite ends of channel 34, and also extend rearwardly toward back wall 26. As described in more detail below, access slots 40 are configured to accommodate the removable attachment of cover 12 transversely to base 14 to allow access to circuit board 18 and mounting holes 42 formed in back wall 14.

Referring to FIGS. 3–4 and 7–9, cover 12 includes a hollow cylindrical sleeve 44 projecting rearwardly from front wall 46 and having an inner surface 48 sized to accommodate the insertion of post 28. Pins 50 project inwardly into sleeve 44 and are arranged on surface 48 to align with entry slots 36 as sleeve 44 is slid over post 28 in order to attach cover 12 to base 14. Front wall 46 terminates at a rear rim 47 in which a groove 49 is formed and configured to matingly receive side wall 27.

Referring to FIGS. 2–4 and 6–9, a method for mounting siren housing 10 to a support structure 22 is described. Specific attention is called to FIG. 4 as a pin 50 is shown sectioned from sleeve 44 and positioned in several locations during the method. For clarity, only the visible details of FIG. 4 will be discussed although it should be understood that the same description is applicable to the features hidden in FIG. 4.

Sleeve 44 is axially aligned with and inserted over post 28 so that pin 50 passes through entry slot 36 and into channel 34. Cover 12 is then rotated until pin 50 is aligned with access slot 40, at which point sleeve 44 is further inserted over post 28 and pin 50 passes into access slot 40. Thus, cover 12 is removably secured to base 14 and an installer is able to easily hold siren housing 10 during installation.

Siren housing 10 is then mounted to a support structure 22, such as a wall, by using screws 42 to attach base 14 to the support structure. Those skilled in the art will understand that many suitable mounting methods are possible, such as using nails, rivets, or adhesives.

After siren housing 10 has been mounted, installation is completed by moving cover 12 frontwardly to withdraw sleeve 44 from post 32 and pass pin 50 from access slot 40 to channel 34. Cover 12 is rotated to align with base 14, thereby passing pin 50 through channel 34 until aligned with exit slot 38. Finally, cover 12 is moved rearwardly onto base 14, passing pin 50 into exit slot 38, until groove 47 matingly engages with side wall 27 and cover 14 is seated on base 12.

In light of the foregoing, it will now be appreciated by those skilled in the art that various changes may be made to the embodiment herein chosen for purposes of this disclosure without departing from the inventive concept defined by the following claims.

What is claimed is:

1. A siren housing, comprising:

a dish-shaped base having a back wall adapted to be secured to as support structure, said base being configured and dimensioned to contain siren components;

a post projecting forwardly from said back wall, said post having a cylindrical side wall terminating at a front rim;

at least one channel circumscribing a segment of said side wall at a location spaced rearwardly from said front rim;

entry and exit slots communicating with said channel at spaced locations along the length thereof, said entry slot leading to said front rim and said exit slot leading towards said back wall;

a dish-shaped cover having a front wall;

a cylindrical sleeve projecting rearwardly from said front wall, said sleeve having at least one pin projecting radially inwardly therefrom;

said sleeve being dimensioned for axial insertion onto said post and said pin being arranged:

i. to enter said channel via said entry slot;

ii. to coact with said channel in supporting said cover above said base for movement between open and closed positions; and iii. to exit said channel via said exit slot to accommodate seating of said closed cover on said base.

2. The siren housing of claim 1 further comprising an access slot communicating with said channel at a location spaced from said entry and exit slots, said access slot leading toward said back wall.

3. The siren housing of claim 2, wherein said pin is arranged to coact with said channel for movement between an open position and an access position and to exit said channel via said access slot to accommodate seating of said cover transverse to said base for accessing said siren components and for securing said base to a support structure.

4. The siren housing of claim 1, wherein said at least one channel comprises first and second channels circumscribing segments of said side wall at locations spaced rearwardly from said front rim.

5. The siren housing of claim 4 further comprising entry and exit slots communicating with said second channel at spaced locations along the length thereof, said entry slot leading to said front rim and said exit slot leading towards said back wall.

6. The siren housing of claim 1, wherein said at least one pin comprises first and second pins projecting radially inwardly from said sleeve.

7. The siren housing of claim 1, wherein base has an opening for electrically connecting said siren components to an alarm system.

8. A method of mounting a siren housing to a wall comprising:

providing a siren housing comprising:

a dish-shaped base having a back wall adapted to be secured to as support structure, said base being configured and dimensioned to contain siren components;

a post projecting forwardly from said back wall, said post having a cylindrical side wall terminating at a front rim;

at least one channel circumscribing a segment of said side wall at a location spaced rearwardly from said front rim;

an entry slot, an exit slot, and an access slot communicating with said channel at spaced locations along the length thereof, said entry slot leading to said front rim and said exit and access slots leading towards said back wall;

a dish-shaped cover having a front wall; and a cylindrical sleeve projecting rearwardly from said front wall, said sleeve having at least one pin projecting radially inwardly therefrom, said sleeve being dimensioned for axial insertion onto said post;

inserting said sleeve onto said post and thereby passing the pin through the entry slot;

rotating said cover to pass said pin through said channel and align with said access slot;

inserting said sleeve further onto said post and thereby passing said pin into said access slot;

mounting said housing to a support structure;

withdrawing said sleeve from said post so that said pin passes into said channel, rotating said cover to pass said pin through said channel and align with said exit slot, and inserting said sleeve onto said post, thereby passing said pin into said exit slot and seating said cover on said base.

* * * * *